US009527302B2

(12) United States Patent
Kamei et al.

(10) Patent No.: US 9,527,302 B2
(45) Date of Patent: Dec. 27, 2016

(54) LIQUID EJECTING APPARATUS WITH PRESSURE ADJUSTING VALVE

(71) Applicant: SEIKO EPSON CORPORATION, Tokyo (JP)

(72) Inventors: Hiroyuki Kamei, Azumino (JP); Hitotoshi Kimura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 39 days.

(21) Appl. No.: 14/792,044

(22) Filed: Jul. 6, 2015

(65) Prior Publication Data

US 2016/0001568 A1 Jan. 7, 2016

(30) Foreign Application Priority Data

Jul. 7, 2014 (JP) ..... 2014-139411
Feb. 3, 2015 (JP) ..... 2015-019075

(51) Int. Cl.
*B41J 2/175* (2006.01)

(52) U.S. Cl.
CPC ..... *B41J 2/17596* (2013.01); *B41J 2/175* (2013.01)

(58) Field of Classification Search
CPC . B41J 2/17556; B41J 2/17566; B41J 2/17596; B41J 1/18
See application file for complete search history.

(56) References Cited

U.S. PATENT DOCUMENTS 8,303,094 B2 * 11/2012 Furukawa ..... B41J 2/175 347/84
2011/0199424 A1 8/2011 Yokouchi et al.
2011/0211029 A1 9/2011 Enomoto et al.
2013/0010037 A1 1/2013 Yokoyama et al.
2013/0286114 A1 10/2013 Ito et al.

FOREIGN PATENT DOCUMENTS

JP 2011-110853 A 6/2011
JP 2011-178013 A 9/2011
JP 2011-183795 A 9/2011
JP 2011-255643 A 12/2011
JP 2012-096474 A 5/2012
JP 2012-101519 A 5/2012
JP 2012-116144 A 6/2012
JP 2013-126773 A 6/2013
JP 2013-240984 A 12/2013

* cited by examiner

*Primary Examiner* — Bradley Thies
(74) *Attorney, Agent, or Firm* — Workman Nydegger

(57) ABSTRACT

A liquid ejecting apparatus includes a liquid ejecting section that includes a nozzle that ejects a liquid; a supplying path that is capable of supplying the liquid accommodated in a liquid accommodating section to the liquid ejecting section; a pressure adjusting valve that is disposed in the supplying path, and includes a pressure chamber which is capable of storing the liquid, the pressure chamber being is provided with an outlet that draws out the stored liquid to the liquid ejecting section, and when a pressure in the internal portion of the pressure chamber decrease, the pressure adjusting valve being opened to adjust a pressure of the liquid supplied to the liquid ejecting section; a discharging path that connects to a communicating port which communicates with the pressure chamber in a separate position different from a position of the outlet; and a switching valve that is provided in the discharging path.

13 Claims, 7 Drawing Sheets

LIQUID EJECTING APPARATUS WITH PRESSURE ADJUSTING VALVE

BACKGROUND

1. Technical Field

The present invention relates to, for example, a liquid ejecting apparatus of an ink jet type printer and the like.

2. Related Art

As an example of the liquid ejecting apparatus of a related art, there is an ink jet type printer in which ink (liquid) that is supplied from a liquid storage section (a liquid accommodating section) is ejected to media from a liquid ejecting section to thereby perform printing. Further, among these types printers, there is a printer in which a pressure adjusting valve called a self-sealing valve is provided in the midway of a supplying path through which ink is supplied from the liquid storage section to the liquid ejecting section (For example, JP-A-2011-255643).

The pressure adjusting valve includes a pressure chamber that causes the ink to stay. When the ink is consumed in a liquid ejecting head (a liquid ejecting section) and thus a pressure of the ink in the internal portion of the pressure chamber decreases, the valve body is moved to a valve opening position to be opened. For this reason, the ink is adjusted by the pressure adjusting valve so as to have a predetermined pressure that is capable of forming a meniscus in a nozzle, and as a result, the ink is supplied from the liquid storage section to the liquid ejecting head.

Further, in the case of such a printer, gas bubbles are likely to be generated in the internal portion of the pressure chamber of the pressure adjusting valve. In the related arts, such gas bubbles companying the ink are discharged from the internal portion of the pressure chamber through the liquid ejecting head. However, in a case where the ink mixed with the gas bubbles (fluid) is discharged from the internal portion of the pressure chamber through the liquid ejecting head, the gas bubbles in the internal portion of the liquid ejecting head remain, and thus there is a problem in that a reverse effect is exerted to the ejection of the liquid.

Further, such a problem occurs in not only the ink jet type printer, but also commonly occurs in a liquid ejecting apparatus in which a pressure adjusting valve is disposed in a supplying path through which liquid is supplied to the liquid ejecting section.

SUMMARY

An advantage of some aspects of the invention is that there are provided a liquid ejecting apparatus in which it is possible to discharge a fluid from a pressure adjusting valve without intervention of the liquid ejecting section.

Hereinafter, means of the invention and operation effect thereof will be described.

According to an aspect of the invention, there is provided a liquid ejecting apparatus including: a liquid ejecting section that includes a nozzle that ejects a liquid; a supplying path that is capable of supplying the liquid accommodated in a liquid accommodating section to the liquid ejecting section; a pressure adjusting valve that is disposed in the supplying path, and includes a pressure chamber which is capable of storing the liquid, wherein the pressure chamber is provided with an outlet that draws out the stored liquid to the liquid ejecting section, and wherein when the liquid is drawn out of the outlet to the liquid ejecting section to thereby cause a pressure in the internal portion of the pressure chamber to decrease, the a valve body included in the pressure adjusting valve is opened to cause the supplying path and the pressure chamber to communicate with each other through an open hole and thereby adjusts a pressure of the liquid supplied to the liquid ejecting section; a discharging path that connects to a communicating port which communicates with the pressure chamber in a separate position different from a position of the outlet; and a switching valve that is provided in the discharging path.

According to the configuration, even in a case where gas bubbles are generated in the internal portion of the pressure chamber of the pressure adjusting valve, the switching valve is caused to be opened to thereby be capable of discharging the fluid in the internal portion of the pressure chamber through the communicating port and the discharging path. Accordingly, it is possible to discharge the fluid from the pressure adjusting valve without intervention of the liquid ejecting section.

In the liquid ejecting apparatus, it is preferable that the communicating port is opened in a higher position than the outlet in the pressure chamber.

In a case where gas bubbles are generated in the pressure chamber, because the gas bubbles have a lighter weight than that of the liquid, the gas bubbles are collected in the upper portion of the pressure chamber. For this reason, according to the configuration, the communicating port is opened in the upper portion of the pressure chamber, and thus it is possible to easily discharge the fluid.

In the liquid ejecting apparatus, it is preferable that the discharging path is connected to the supplying path through a connecting port, and the connecting port is located farther opposite to the liquid ejecting section than the pressure adjusting valve in the supplying path.

The gas bubbles gradually disappear as time passes, or disappear as the gas bubbles come in contact with new liquid. For this reason, according to the configuration, the connecting port is provided in farther opposite to the liquid ejecting section than the pressure adjusting valve in the supplying path. Therefore, while gas bubbles existing in the fluid that is discharged from the communicating port is caused to decrease, it is possible to cause the discharged fluid to return to the pressure chamber through the discharging path and the supplying path.

In the liquid ejecting apparatus, it is preferable that a cap is further included, which is capable of sealing a space including the nozzle, and in a state where the space is sealed by the cap, the switching valve is caused to be opened to thereby discharge the fluid in the internal portion of the pressure chamber through the discharging path.

In a case where the fluid in the internal portion of the pressure chamber is discharged through the discharging path, there is a problem in that the pressure in the internal portion of the pressure chamber decreases and air is likely to be suctioned from the nozzle. For this reason, according to the configuration, the cap is used to perform the sealing, and thus it is possible to alleviate the problem that the air is suctioned from the nozzle.

In the liquid ejecting apparatus, it is preferable that a fluid flowing mechanism is further included, which is provided to be capable of discharging the fluid in the internal portion of the pressure chamber through the discharging path, and when discharging the fluid in the internal portion of the pressure chamber through the discharging path, the fluid flowing mechanism is driven such that a negative pressure acting on the nozzle is smaller than a pressure resistance of a meniscus formed in the nozzle.

According to the configuration, even in a case where the fluid flowing mechanism is driven, it is possible for the liquid in the nozzle to maintain the meniscus. For this reason, when the fluid is discharged through the discharging path, it is possible to alleviate the problem that the air is suctioned from the nozzle.

In the liquid ejecting apparatus, it is preferable that a fluid flowing mechanism is further included, which is provided to be capable of discharging the fluid in the internal portion of the pressure chamber through the discharging path, and when discharging the fluid in the internal portion of the pressure chamber through the discharging path, the fluid flowing mechanism is driven such that a negative pressure acting on the pressure chamber is greater than a pressure that causes the pressure adjusting valve to be opened.

According to the configuration, since the fluid flowing mechanism is driven to thereby cause the pressure adjusting valve to be opened, the liquid flows into the pressure chamber from the supplying path. For this reason, the gas bubbles in the pressure chamber companying the introduced liquid is strongly discharged from the communicating port and it is possible to efficiently discharge the gas bubbles in the inner portion of the pressure chamber.

In the liquid ejecting apparatus, it is preferable that a fluid flowing mechanism is further included, which is provided to be capable of discharging the fluid in the internal portion of the pressure chamber through the discharging path, or introducing the fluid to the internal portion of the pressure chamber, and in a state where the switching valve is opened, the fluid flowing mechanism is driven such that the fluid is introduced from the communicating port to the internal portion of the pressure chamber.

According to the configuration, in addition to the ability of being capable of discharging the fluid from the communicating port, due to the state where the internal portion of the pressure chamber is pressurized, it is possible to pressurize and supply the liquid to the liquid ejecting section. For this reason, it is possible to perform the pressurizing cleaning on the liquid ejecting section.

In the liquid ejecting apparatus, it is preferable that a bypass path is further included, which connects the switching valve and the connecting port in the discharging path, and the pressure adjusting valve and the connecting port in the supplying path.

According to the configuration, Due to the provision of the bypass path, it is possible to form a circulation path through which the liquid can be circulated without passing through the pressure adjusting valve.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the embodiments of a liquid ejecting apparatus will be described with reference to the drawings.

The liquid ejecting apparatus is an ink jet type printer that ejects ink as an example of the liquid to media such as paper to thereby perform printing.

First Embodiment

Figure 1:
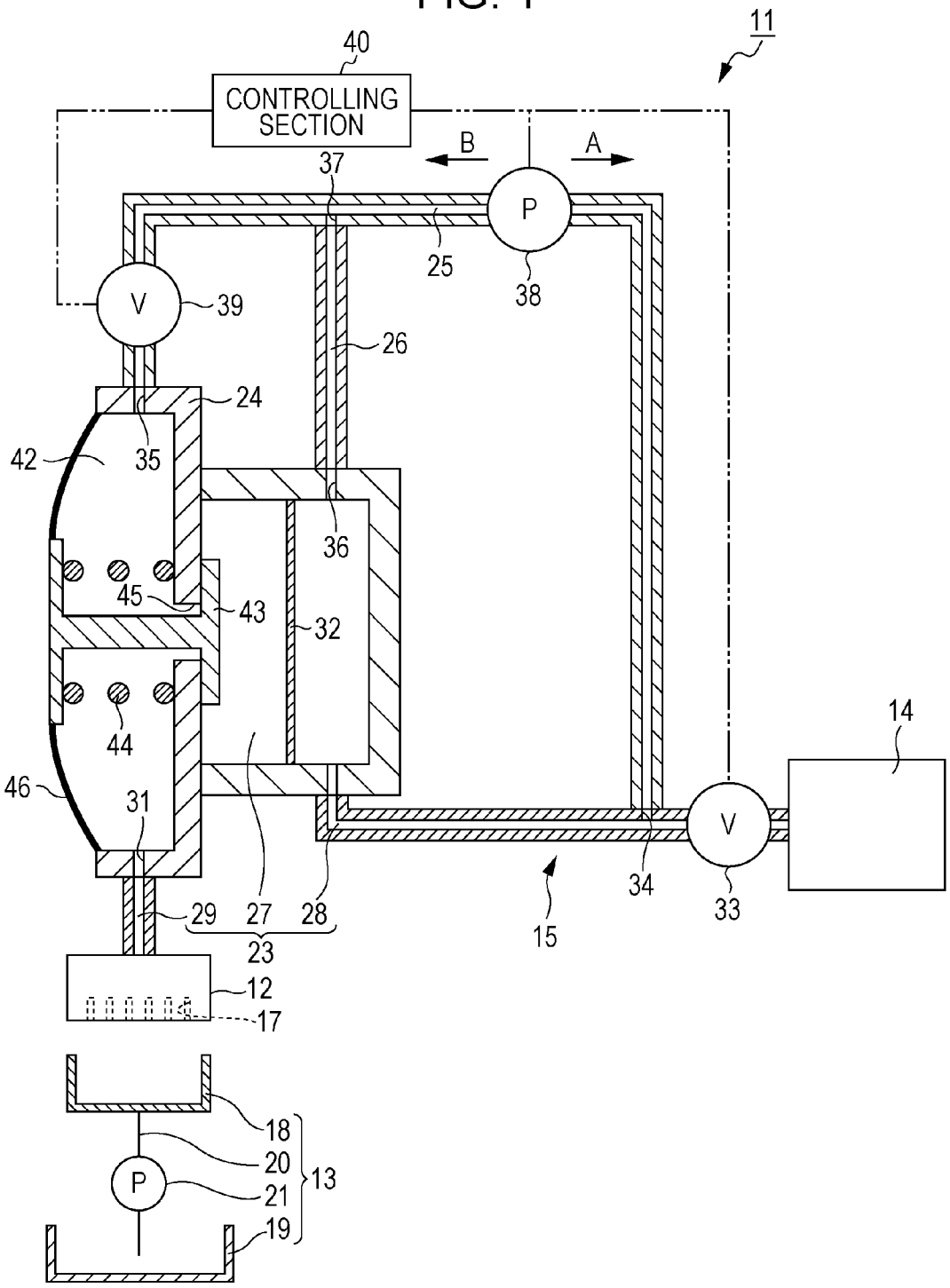
FIG. 1 is a schematic sectional view showing a liquid ejecting apparatus of the first embodiment.

As shown in FIG. 1, the liquid ejecting apparatus 11 of the embodiment includes a liquid ejecting section 12 that ejects a liquid, a maintenance mechanism 13 that performs a maintenance of the liquid ejecting section 12, and a supplying mechanism 15 that is capable of supplying the liquid to the liquid ejecting section 12 from a liquid accommodating section 14 that accommodates the liquid. The liquid accommodating section 14 is detachably provided in the supplying mechanism 15, and the liquid accommodated in the liquid accommodating section 14 is pressurized so that the pressurized liquid can be supplied to the supplying mechanism 15.

The liquid ejecting section 12 includes at least one nozzle 17 (plural nozzles in the embodiment) in the nozzle forming surface. Further, the liquid supplied from the liquid accommodating section 14 is ejected from the nozzle 17 in the form of droplets.

The maintenance mechanism 13 includes a cap 18 that is capable of moving relative to the liquid ejecting section 12, a waste liquid accommodating section 19, a waste liquid path 20 that connects the cap 18 and the waste liquid accommodating section 19 with each other, and a pressure reducing mechanism 21 provided in the waste liquid path 20. The cap 18 has a box-like shape with a bottom and an opening formed thereon, and is moved in the direction in which the cap comes close to the liquid ejecting section 12 to thereby be capable of surrounding a space in which the nozzle 17 exists. Further, in the embodiment, that the cap 18 seals the space including the nozzle 17 in this way is referred to as "being capped".

The supplying mechanism 15 includes a supplying path 23 that is capable of supplying the liquid accommodated in the liquid accommodating section 14 to the liquid ejecting section 12, and a pressure adjusting valve 24 that is provided in the supplying path 23. Further, the supplying mechanism 15 includes a discharging path 25 that connects the pressure adjusting valve 24 and the supplying path 23 with each other, and a bypass path 26 that connects the discharging path 25 and a supplying path 23 with each other.

The supplying path 23 is configured to include a supplying chamber 27 that supplies the liquid to the pressure adjusting valve 24, an accommodating section side supplying path 28 that connects the supplying chamber 27 and the liquid accommodating section 14 with each other, and an ejecting section side supplying path 29 that connects the pressure adjusting valve 24 and the liquid ejecting section 12 with each other. Further, the ejecting section side supplying path 29 connects to the pressure adjusting valve 24 through an outlet 31. Further, the supplying chamber 27 is provided with a filter 32 that is capable of capturing gas bubbles or foreign materials existing in the liquid. Further, the accommodating section side supplying path 28 is provided with a supplying valve 33.

The discharging path 25 has one end connecting to the supplying path 23 through a connecting port 34, and the other end connecting to a communicating port 35 of the pressure adjusting valve 24. Further, the bypass path 26 has one end connecting to a supplying port 36 of the supplying path 23 and the other end connecting to a discharging port 37 of the discharging path 25. Accordingly, a circulating path through which a fluid can circulate is configured to include the discharging path 25, the bypass path 26, the supplying chamber 27 and the accommodating section side supplying path 28.

Further, the connecting port 34 is located in the accommodating section side supplying path 28, and the accommodating section side supplying path 28 and the supplying chamber 27 are located farther opposite to liquid ejecting section 12 than the pressure adjusting valve 24 in the supplying path 23. In other words, in the accommodating section side supplying path 28, the supplying valve 33 and the connecting port 34 are sequentially provided in an order of connection to the liquid accommodating section 14. Further, the supplying port 36 is provided close to the connecting port 34 when compared with the position of the filter 32 in the supplying chamber 27 which is located closer to the pressure adjusting valve 24 than the position of the connecting port 34.

In the discharging path 25, a fluid flowing mechanism 38 that is capable of causing the liquid in the internal portion of the discharging path 25 to flow is provided in a position between the discharging port 37 and the connecting port 34. Further, in the discharging path 25, a switching valve 39 is provided in a position between the discharging port 37 and the communicating port 35.

In other words, the bypass path 26 connects the switching valve 39 and the connecting port 34 in the discharging path 25, and connects the pressure adjusting valve 24 and the connecting port 34 in the supplying path 23. Further, a controlling section 40 performs a driving control on the fluid flowing mechanism 38, the supplying valve 33 and switching valve 39.

The pressure adjusting valve 24 includes a pressure chamber 42 that is capable of storing a liquid, a valve body 43 provided between the pressure chamber 42 and the supplying chamber 27, and a force exerting member 44 that exerts a force to the valve body 43 in the direction causing the valve body 43 to be closed. In other words, an opening hole 45 is formed between the pressure chamber 42 and the supplying chamber 27, and the valve body 43 is configured to be forced by the force exerting member 44 and thereby block the opening hole 45.

The pressure chamber 42 is configure to include a diaphragm 46 that constitutes a part of a wall surface of the pressure chamber 42 and is capable of being flexibly deformed in the force exerting direction of the force exerting member 44. The diaphragm 46 has the external surface (the left side surface in FIG. 1) on which the atmospheric pressure is exerted, and the internal surface (the right side surface in FIG. 1) on which the liquid existing in the internal portion of the pressure chamber 42 exerts a pressure. Accordingly, the diaphragm 46 is flexibly displaced in response to a change of the pressure in the internal portion of the pressure chamber 42.

Further, an outlet 31 connecting to the ejecting section side supplying path 29 and a communicating port 35 connecting to the discharging path 25 are opened in the pressure chamber 42. In other words, the liquid stored in the pressure chamber 42 is drawn out of the outlet 31 to the liquid ejecting section 12. Further, the communicating port 35 communicating with the pressure chamber 42 in a separate position from the outlet 31 is opened in a higher position than the position of the outlet 31 in the vertical direction in the pressure chamber 42. Further, the cross sectional surface area of the pressure chamber 42 in the horizontal direction has a small size in the direction in which the chamber comes close to the communicating port 35 when compared with the case of the central portion in the vertical direction.

Further, the pressure adjusting valve 24 adjusts the pressure of the liquid supplied to the liquid ejecting section 12 so as to adjust the pressure which is the backpressure of the nozzle 17 in the internal portion of the liquid ejecting section 12. In other words, in order that a concave-like meniscus which is appropriate for ejecting the liquid is formed in the internal portion of the nozzle 17, a negative pressure state in a certain range is maintained in the internal portion of the pressure chamber 42. Further, the meniscus means a curved liquid surface generated due to an adhesive force taking effect when the liquid contacts the nozzle 17 and a magnitude relation of a cohesive force between liquid molecules.

The supplying chamber 27 is maintained in a pressurized state caused by the liquid pressurized and transferred from the liquid accommodating section 14. Further, when the liquid ejecting section 12 does not eject the liquid, the valve body 43 uses the exerting force of the force exerting member 44 to regulate a communication between the pressure chamber 42 in the negative pressure state and the supplying chamber 27 in the pressurized state.

Hereinafter, a description will be made of an operation in a case where the liquid ejecting apparatus 11 configured as described above ejects the liquid to the target from the nozzle 17 in terms of an operation of the supplying mechanism 15.

The controlling section 40 causes the supplying valve 33 to be opened, the switching valve 39 to be closed, and a driving of the fluid flowing mechanism 38 to be stopped. In this state, if the liquid is ejected from the liquid ejecting section 12, the liquid in the internal portion of the pressure chamber 42 is drawn out of the outlet 31 and is supplied to the liquid ejecting section 12 through the ejecting section side supplying path 29. If this occurs, the pressure in the internal portion of the pressure chamber 42 decreases, and thus the negative pressure increases. Accordingly, the diaphragm 46 pressurizes the valve body 43 against the exerting force of the force exerting member 44 to cause the valve body 43 to be moved to the valve opening position, and thus, the pressure adjusting valve 24 becomes opened. Therefore, the supplying chamber 27 and the pressure chamber 42 communicates with each other through the opening hole 45, and thus the liquid flows from the supplying chamber 27 of the pressurized state into the internal portion of the pressure chamber 42.

If this occurs, the pressure in the internal potion of the pressure chamber 42 increases and the negative pressure decreases. Therefore, the flexibly deformed diaphragm 46 is displaced in the direction of causing the diaphragm 46 to be separated away from the supplying chamber 27. If this occurs, again, the valve body 43 is moved to the valve closing position in which the valve body 43 blocks the opening hole 45 and thus regulates the communication between the pressure chamber 42 and the supplying chamber 27. In this way, the pressure adjusting function of the pressure adjusting valve 24 is used to maintain the negative pressures state that is appropriate for ejection of the liquid in the internal portion of the pressure chamber 42.

However, since the liquid is stored in the pressure chamber 42, the gas dissolved in the liquid is likely to become gas bubbles. Therefore, hereinafter, an operation in a case where the gas bubbles generated in the internal portion of the pressure chamber 42 are discharged will be described.

Herein, in a state where the liquid ejecting section 12 is capped by the cap 18, the controlling section 40 causes the switching valve 39 to be opened, causes the supplying valve 33 to be closed, and causes the fluid flowing mechanism 38 to perform a normal rotational driving. If this occurs, the liquid in the internal portion of the discharging path 25 flows in the discharging direction A that goes from the fluid flowing mechanism 38 to the connecting port 34, and the liquid in the internal portion of the pressure chamber 42 companying the gas bubbles is discharged to the discharging path 25 through the communicating port 35. In other words, the fluid flowing mechanism 38 discharge the fluid in the internal portion of the pressure chamber 42 through the discharging path 25.

In this case, the controlling section 40 causes the fluid flowing mechanism 38 to be driven so that a negative pressure in the pressure chamber 42 is lower than the pressure resistance of the meniscus that is capable of retaining the meniscus in the nozzle 17 of the negative pressure in the pressure chamber 42, and greater than a negative pressure that is capable of opening the pressure adjusting valve 24. For this reason, the inflow of the liquid into the internal portion of the pressure chamber 42 from the outlet 31 is suppressed, and the valve body 43 is moved to a valve opening position to thereby cause the supplying chamber 27 and the pressure chamber 42 to communicate with each other. Accordingly, after a fluid formed of the liquid and the gas bubbles in the internal portion of the pressure chamber 42 is discharged from the communicating port 35, the fluid flows through the discharging path 25, the accommodating section side supplying path 28 and the supplying chamber 27 in the order listed, and then, the fluid passes through the filter 32 in the supplying chamber 27 to flow into the pressure chamber 42 from the opening hole 45.

Hereinafter, a description will be made of an operation in a case where the liquid is circulated in the supplying mechanism 15.

Herein, in a state where the liquid ejecting section 12 is located at a position so as to face the cap 18, the controlling section 40 causes the supplying valve 33 and the switching valve 39 to be closed, and causes the fluid flowing mechanism 38 to perform the normal rotational running. If this occurs, the liquid in the internal portion of the discharging path 25 flows in the discharging direction A. For this reason, the liquid that flows into the accommodating section side supplying path 28 from the connecting port 34 circulates to pass through the supplying chamber 27, the supplying port 36, the bypass path 26, the discharging port 37, and the discharging path 25 in the order listed.

Hereinafter, a description will be made of an operation of the supplying mechanism 15 in a case where a pressurizing cleaning is performed on the liquid ejecting section 12.

Herein, in a state where the liquid ejecting section 12 is capped by the cap 18, the controlling section 40 causes the switching valve 39 and the supplying valve 33 to be opened, and causes the fluid flowing mechanism 38 to perform a reverse rotational running. If this occurs, the liquid flows in the cleaning direction B that goes from the connecting port 34 to the fluid flowing mechanism 38 in the discharging path 25.

In other words, the fluid flowing mechanism 38 introduces the fluid from the communicating port 35 to the pressure chamber 42 through the discharging path 25. In this case, since the negative pressure in the internal portion of the pressure chamber 42 is relieved, the valve body 43 is located at the valve closing position in which the opening hole 45 is blocked to thereby regulate a communication between the pressure chamber 42 and the supplying chamber 27. Accordingly, the fluid flown into the pressure chamber 42 is drawn out of the outlet 31 and discharged from the nozzle 17 of the liquid ejecting section 12.

Hereinafter, a description will be made of an operation in a case where the maintenance mechanism 13 performs suction cleaning on the liquid ejecting section 12.

In a state where the liquid ejecting section 12 is capped by the cap 18, when the pressure reducing mechanism 21 is driven, the internal portion of the cap 18 is in a negative pressure, and thus the liquid is suctioned from the nozzle 17. After this, the controlling section 40 performs the pressurizing cleaning described above. In other words, the controlling section 40 causes the switching valve 39 and the supplying valve 33 to be opened, and causes the fluid flowing mechanism 38 to perform the reverse rotational running. If this occurs, the liquid flowing in the cleaning direction B flows into the pressure chamber 42 from the communicating port 35, and thus the negative pressure in the pressure chamber 42 decreases.

According to the first embodiment describe above, it is possible to obtain the following effect.

(1) Even in a case where gas bubbles are generated in the internal portion of the pressure chamber 42 of the pressure adjusting valve 24, the switching valve 39 is caused to be opened to thereby be capable of discharging the fluid in the internal portion of the pressure chamber 42 through the communicating port 35 and the discharging path 25. Accordingly, it is possible to discharge the fluid from the pressure adjusting valve 24 without intervention of the liquid ejecting section 12.

(2) In a case where gas bubbles are generated in the pressure chamber 42, because the gas bubbles have a lighter weight than that of the liquid, the gas bubbles are collected in the upper portion of the pressure chamber 42. For this reason, the communicating port 35 is opened in the upper portion of the pressure chamber 42, and thus it is possible to easily discharge the fluid.

(3) The gas bubbles gradually disappear as time passes, or disappear as the gas bubbles come in contact with new liquid. For this reason, the connecting port 34 is provided in farther opposite to the liquid ejecting section 12 than the pressure adjusting valve 24 in the supplying path 23. Therefore, while gas bubbles existing in the fluid that are discharged from the communicating port 35 is caused to decrease, it is possible to cause the discharged fluid to return to the pressure chamber 42 through the discharging path 25 and the supplying path 23.

(4) In a case where the fluid in the internal portion of the pressure chamber 42 is discharged through the discharging path 25, there is a problem in that the pressure in the internal portion of the pressure chamber 42 decreases and air is likely to be suctioned from the nozzle 17. For this reason, the cap 18 is used to perform the sealing, and thus it is possible to alleviate the problem that the air is suctioned from the nozzle 17.

(5) Even in a case where the fluid flowing mechanism 38 is driven, it is possible for the liquid in the nozzle 17 to maintain the meniscus. For this reason, when the fluid is discharged through the discharging path 25, it is possible to alleviate the problem that the air is suctioned from the nozzle 17.

(6) Since the fluid flowing mechanism 38 is driven to thereby cause the pressure adjusting valve 24 to be opened, the liquid flows into the pressure chamber 42 from the supplying path 23. For this reason, the gas bubbles in the pressure chamber 42 companying the introduced liquid are strongly discharged from the communicating port 35 and it is possible to efficiently discharge the gas bubbles in the inner portion of the pressure chamber 42.

(7) In addition to the ability to be capable of discharging the fluid from the communicating port 35, due to the state where the internal portion of the pressure chamber 42 is pressurized, it is possible to pressurize and supply the liquid to the liquid ejecting section 12. For this reason, it is possible to perform the pressurizing cleaning on the liquid ejecting section 12.

(8) Due to the provision of the bypass path 26, it is possible to form a circulation path through which the liquid can be circulated without passing through the pressure adjusting valve 24.

(9) Since the fluid flowing mechanism 38 is driven to cause the pressure adjusting valve 24 to be opened, the fluid discharged from the pressure chamber 42 flows through the discharging path 25, the accommodating section side supplying path 28 and the supplying chamber 27 to eventually return to the pressure chamber 42. In other words, since the liquid can be caused to be circulated in the discharging path 25 and the supplying path 23, it is possible to cause the liquid to be circulated, for example, without a configuration having the provision of the bypass path 26. Accordingly, even in the case of a liquid such as pigment ink that causes precipitates to be generated as time passes, it is possible to suppress the consumption of the liquid and to stir up the liquid.

(10) In a case where the supplying mechanism 15 causes the liquid to be circulated, since the cap 18 faces the liquid ejecting section 12, even if the liquid leaks from the nozzle 17, the cap 18 can receive the liquid. Accordingly, it is possible to alleviate the problem that the liquid flies in all directions.

(11) In a case where the supplying mechanism 15 causes the liquid to be circulated, since the cap 18 faces the liquid ejecting section 12, after the circulation of the liquid, it is possible to smoothly transit to a maintenance operation such as suction cleaning that is performed while the liquid ejecting section 12 is capped.

(12) In a case where the suction cleaning is performed, before the cap 18 is separated from the liquid ejecting section 12, the pressurizing cleaning is performed, and thus it is possible to alleviate the problem that the air is suctioned from the nozzle 17.

Second Embodiment

Hereinafter, the second embodiment of the liquid ejecting apparatus will be described with reference to the drawings. Further, the second embodiment is different from the first embodiment in the configuration of the supplying mechanism 48. Further, since the second embodiment is the same as the first embodiment in other respects, like elements are designated by like numbers and the descriptions thereof will not be repeated.

Figure 2:
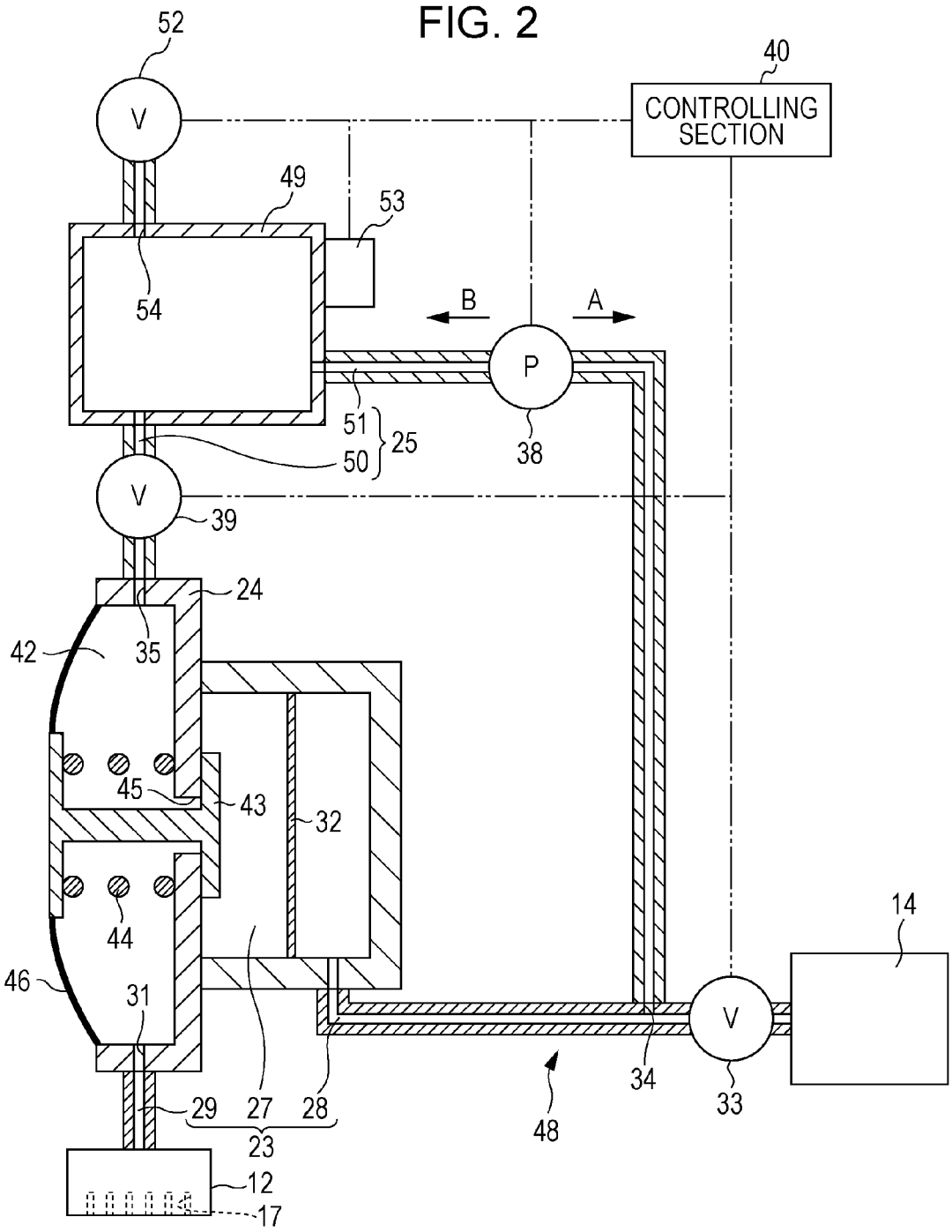
FIG. 2 is a schematic sectional view showing a liquid ejecting apparatus of the second embodiment.

As shown in FIG. 2, the supplying mechanism 48 includes the fluid storage section 49 provided between the switching valve 39 and the fluid flowing mechanism 38 in the discharging path 25. In other words, the discharging path 25 is configured to include a switching valve side discharging path 50 in which the switching valve 39 is provided close to the pressure adjusting valve 24 when compared with the case of the fluid storage section 49, and a fluid flowing mechanism side discharging path 51 in which the fluid flowing mechanism 38 is provided close to the connecting port 34 when compared with the case of the fluid storage section 49.

Further, the fluid storage section 49 is provided with an atmospheric opening valve 52 that is capable of causing the internal portion of the fluid storage section 49 to be opened to the atmosphere. Also, the fluid storage section 49 is provided with a liquid level sensor 53 that is capable of detecting a position of the liquid surface of the liquid stored in the fluid storage section 49.

Further, the switching valve side discharging path 50 and the flowing mechanism side discharging path 51 connect to the fluid storage section 49 at lower positions in the vertical direction than the position of an opening port 54 connecting to the atmospheric opening valve 52 in the fluid storage section 49. Further, the controlling section 40 acquires a detection result from the liquid level sensor 53 and controls driving of the fluid flowing mechanism 38, the supplying valve 33, the switching valve 39, and the atmospheric opening valve 52.

Hereinafter, an operation of the supplying mechanism 48 will be described. However, since the operation in a case where the liquid is ejected to a target from the nozzle 17, the operation in case where the pressurizing cleaning is performed, and the operation in a case where suction cleaning is performed are the same as those of the first embodiment, and thus the descriptions thereof are not repeated. Further, hereinafter, an operation in a case where the gas bubbles generated in the internal portion of the pressure chamber 42 is discharged, and the liquid in the supplying mechanism 48 is circulated will be described.

Herein, in a state where the liquid ejecting section 12 is capped by the cap 18 (not shown in FIG. 2), the controlling section 40 causes the supplying valve 33 and the atmospheric opening valve 52 to be closed, causes the switching valve 39 to be opened, and causes the fluid flowing mechanism 38 to perform a normal rotational running. If this occurs, the liquid in the internal portion of the flowing mechanism side discharging path 51 flows in the discharging direction A that goes from the fluid flowing mechanism 38 to the connecting port 34, and the liquid in the pressure chamber 42 companying the gas bubbles is discharged to the switching valve side discharging path 50 through the communicating port 35.

In this case, the controlling section 40 causes the fluid flowing mechanism 38 to be driven so that a negative pressure in the pressure chamber 42 is smaller than the pressure resistance of the meniscus of the nozzle 17, and greater than a negative pressure that is capable of opening the pressure adjusting valve 24. For this reason, the inflow of the liquid into the pressure chamber 42 from the outlet 31 is suppressed, and the valve body 43 is moved to a valve opening position to thereby cause the supplying chamber 27 and the pressure chamber 42 to communicate with each other. Accordingly, the liquid flows into the pressure chamber 42 from the supplying chamber 27. In other words, the fluid circulates to pass through the pressure chamber 42, the communicating port 35, the switching valve side discharging path 50, the fluid storage section 49, the flowing mechanism side discharging path 51, the connecting port 34, the accommodating section side supplying path 28 and the supplying chamber 27, and the opening hole 45 in the order listed.

However, when the liquid containing the gas bubbles is stored in the fluid storage section 49, the gas bubbles are collected in the upper portion of the fluid storage section 49 in the vertical direction, whereas the liquid is discharged from the flowing mechanism side discharging path 51 provided in the lower portion in the vertical direction. For this reason, in a case where the level of the liquid surface in the internal portion of the fluid storage section 49 decreases (in other words, in a case where the amount of the gas in the internal portion of the fluid storage section 49 increases), based on the detection result of the liquid level sensor 53, the controlling section 40 causes the atmospheric opening valve 52 to be opened, causes the switching valve 39 to be closed, causes the supplying valve 33 to be opened, and causes the fluid flowing mechanism 38 to perform the reverse rotational running. If this occurs, the liquid in the internal portion of the flowing mechanism side discharging path 51 flows in the cleaning direction B that goes from the fluid flowing mechanism 38 to the fluid storage section 49. For this reason, the gas is discharged from the fluid storage section 49 through the opening port 54 and the atmospheric opening valve 52, the liquid is caused to flows into the fluid storage section 49, and thus, the level of the liquid surface in the internal portion of the fluid storage section 49 increases.

According to the second embodiment, in addition to the effect (1) to (12) of the first embodiment, it is possible to obtain the following effect.

(13) The supplying mechanism 48 is provided with the fluid storage section 49 including the atmospheric opening valve 52, and thus it is possible to discharge the gas bubbles that are discharged from the pressure chamber 42 to the external portion of the supplying mechanism 48.

Third Embodiment

Hereinafter, the third embodiment of the liquid ejecting apparatus will be described with reference to the drawings. Further, the third embodiment is different from the first embodiment and the second embodiment in the configuration of the supplying mechanism 56. Further, since the third embodiment is substantially the same as the first embodiment and the second embodiment in other respects, like elements are designated by like numbers and the descriptions thereof will not be repeated.

Figure 3:
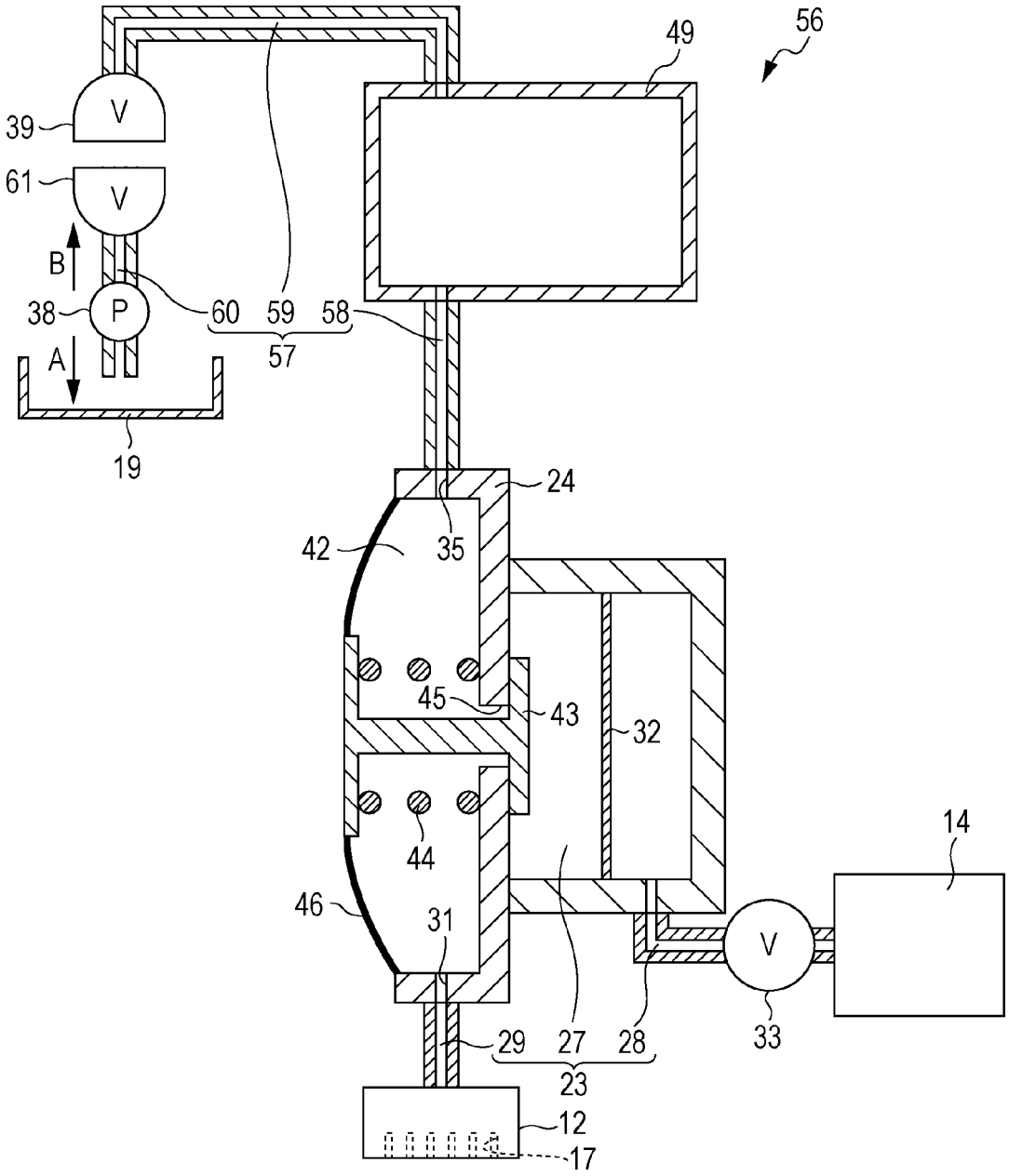
FIG. 3 is a schematic sectional view showing a liquid ejecting apparatus of the third embodiment.

As shown in FIG. 3, the discharging path 57 is configured to include an adjusting valve side discharging path 58 that connects the pressure adjusting valve 24 and the fluid storage section 49 with each other, a switching valve side discharging path 59 that connects the fluid storage section 49 and the switching valve 39 with each other, and a fluid flowing mechanism side discharging path 60 with which the fluid flowing mechanism 38 is provided. Further, the adjusting valve side discharging path 58 has one end connecting to a lower position of the fluid storage section 49 in the vertical direction, and the switching valve side discharging path 59 has one end connecting to an upper position of the fluid storage section 49 in the vertical direction.

Further, one end of the flowing mechanism side discharging path 60 is provided with a normally closed valve 61 that is opened when connecting to the switching valve 39, and the other end of the flowing mechanism side discharging path 60 is opened and provided with a waste liquid accommodating section 19. Further, the normally closed valve 61 is provided to be capable of moving relative to the switching valve 39. The normally closed valve 61 causes the switching valve 39 to be opened in case where the normally closed valve 61 is connected to the switching valve 39. In other words, in a case where both of the switching valve 39 and the normally closed valve 61 are connected to each other, the switching valve 39 and the normally closed valve 61 are opened, whereas in a case where both of the switching valve 39 and the normally closed valve 61 are not connected to each other, the switching valve 39 and the normally closed valve 61 are closed.

Hereinafter, an operation of the supplying mechanism 56 will be described. However, since the operation in a case where the liquid is ejected to a target from the nozzle 17, and the operation in case where the suction cleaning is performed are the same as those of the first embodiment, the descriptions thereof are not repeated. Further, hereinafter, an operation in a case where the gas bubbles generated in the internal portion of the pressure chamber 42 are discharged is discharged will be described.

Herein, when the gas bubbles are generated in the internal portion of the pressure chamber 42, the gas bubbles are moved to the fluid storage section 49 through a communicating port 35 and an adjusting valve side discharging path 58. Further, in a state where the liquid ejecting section 12 is capped by the cap 18 (now shown in FIG. 3) and also the normally closed valve 61 and the switching valve 39 are connected to each other, the controlling section 40 causes the fluid flowing mechanism 38 to perform the normal rotational running. In other words, in a case where the normally closed valve 61 and the switching valve 39 are opened and thus the switching valve side discharging path 59 and the flowing mechanism side discharging path 60 communicate with each other, the fluid flowing mechanism 38 is driven. Therefore, the gas bubbles in the internal portion of the fluid storage section 49 flow in the discharging direction A, and are discharged from the flowing mechanism side discharging path 60.

Hereinafter, a description will be made of an operation of the supplying mechanism 56 in a case where a pressurizing cleaning is performed on the liquid ejecting section 12.

Herein, in a case where the gas bubbles are discharged from the flowing mechanism side discharging path 60, the controlling section 40 causes the fluid flowing mechanism 38 to perform a reverse rotational running. If this occurs, the fluid flows in the cleaning direction B that goes from the fluid flowing mechanism 38 to the normally closed valve 61. For this reason, the air flows in from the flowing mechanism side discharging path 60, and the fluid in the internal portion of the switching valve side discharging path 59 flows to the fluid storage section 49. If this occurs, the internal portion of the fluid storage section 49 is pressurized, and the liquid in the internal portion of the fluid storage section 49 flows into the internal portion of the pressure chamber 42 from the communicating port 35 through the adjusting valve side discharging path 58.

In this case, since the negative pressure in the internal portion of the pressure chamber 42 is relieved, the valve body 43 is located at the valve closing position in which the opening hole 45 is blocked and to thereby regulate a communication between the pressure chamber 42 and the supplying chamber 27. For this reason, the fluid flown into the pressure chamber 42 is drawn out of the outlet 31 and discharged from the nozzle 17 of the liquid ejecting section 12.

According to the third embodiment, in addition to the effect (1) to (13) of the first embodiment and the second embodiment, it is possible to obtain the following effect.

(14) Since the switching valve 39 is caused to come in contact with the normally closed valve 61 to thereby be opened, it is possible to decrease a load applied to the controlling section 40, when compared with a case where the controlling section 40 performs the opening/closing control of the switching valve 39.

Fourth Embodiment

Hereinafter, the fourth embodiment of the liquid ejecting apparatus will be described with reference to the drawings. Further, the fourth embodiment is different from the first embodiment to the third embodiment in the configuration of the supplying mechanism 63. Further, since the fourth embodiment is substantially the same as the first embodiment to the third embodiment in other respects, like elements are designated by like numbers and the descriptions thereof will not be repeated.

Figure 4:
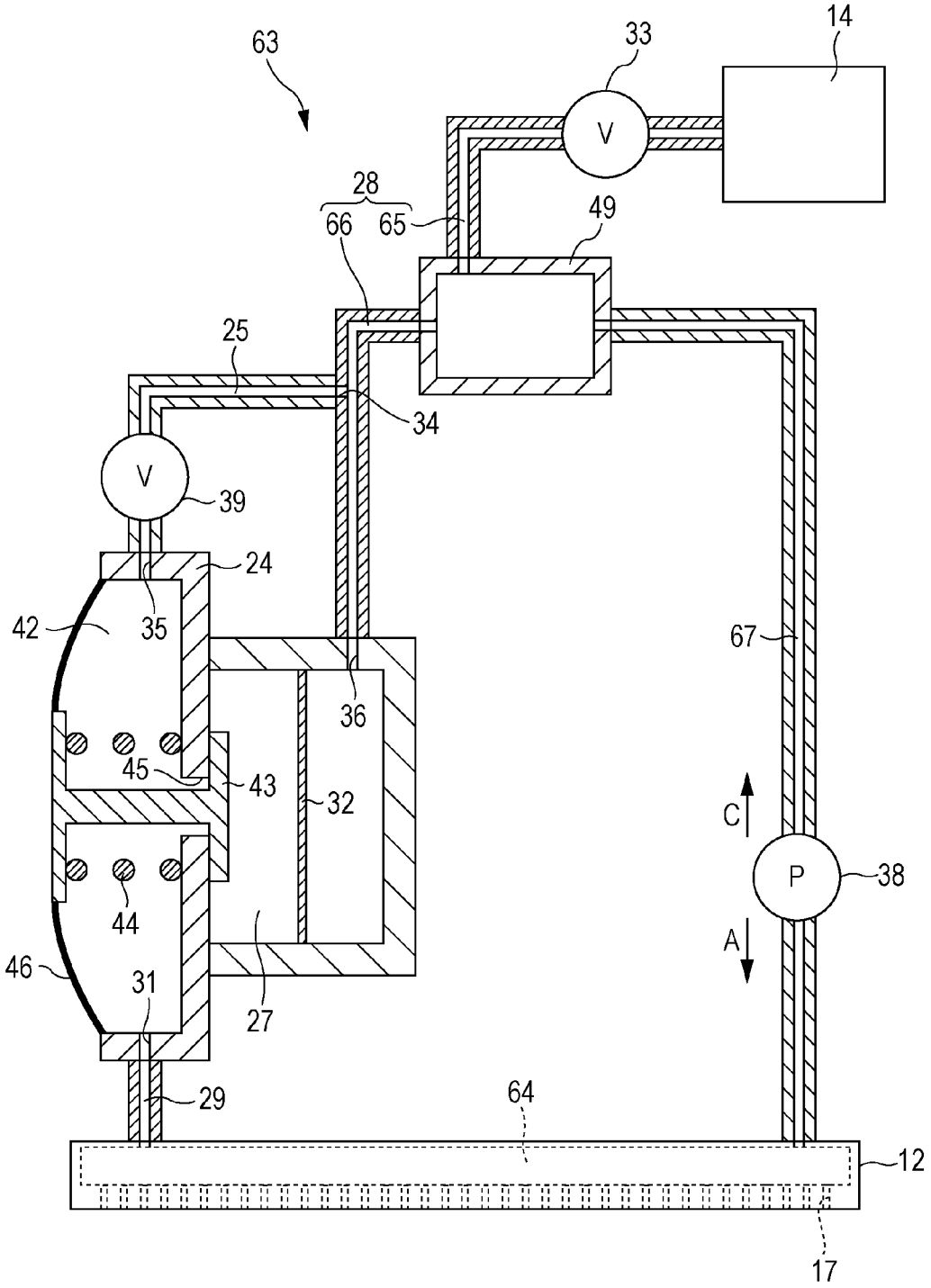
FIG. 4 is a schematic sectional view showing a liquid ejecting apparatus of the fourth embodiment.

FIG. 4 shows a common liquid chamber 64 of the liquid ejecting section 12, and the common liquid chamber 64 is not shown in FIG. 1 to FIG. 3 of the first embodiment to the third embodiment. However, the configuration of the liquid ejecting section 12 is the same as those of the liquid ejecting sections in the first embodiment to the third embodiment. The common liquid chamber 64 is called reservoir and communicates with each nozzle 17 through a cavity (not shown). For this reason, after the liquid supplied from the liquid accommodating section 14 is temporarily stored in the common liquid chamber 64, the liquid is supplied to each nozzle 17.

As shown in FIG. 4, the supplying mechanism 63 includes the fluid storage section 49 that is provided between the supplying valve 33 and the connecting port 34 in the accommodating section side supplying path 28. In other words, the accommodating section side supplying path 28 is configured to include the supplying valve side supplying path 65 in which the supplying valve 33 is provided close to the liquid accommodating section 14 when compared with the case of the fluid storage section 49, and a supplying chamber side supplying path 66 which is provided close to the supplying chamber 27 when compared with the case of the fluid storage section 49.

Further, the supplying chamber side supplying path 66 has one end connecting to the supplying port 36 of the supplying chamber 27. Further, the ejecting section side supplying path 29 has one end connecting to the outlet 31 and the other end connecting to the common liquid chamber 64.

Further, in the embodiment, the supplying path is configured to include the supplying valve side supplying path 65, the supplying chamber side supplying path 66, the supplying chamber 27 and the ejecting section side supplying path 29, and the liquid accommodated in the liquid accommodating section 14 is supplied to the liquid ejecting section 12 through the supplying path.

The discharging path 25 has one end connecting to the connecting port 34 provided in the supplying chamber side supplying path 66, and the other end connecting to the communicating port 35 of the pressure adjusting valve 24.

Further, the supplying mechanism 63 connects the fluid storage section 49 and the liquid ejecting section 12 with each other, and includes a circulating path 67 in which the fluid flowing mechanism 38 is provided. In other words, the circulating path 67 has one end connecting to the common liquid chamber 64.

Hereinafter, a description will be made of an operation of the supplying mechanism 63. However, since the operation in a case where the liquid is ejected to a target from the nozzle 17 and the operation in case where the suctioning cleaning is performed are the same as those of the first embodiment, the descriptions thereof are not repeated. Further, the operation in a case where the gas bubbles generated in the internal portion of the pressure chamber 42 is discharged will be described.

Herein, in a state where the liquid ejecting section 12 is capped by the cap 18 (not shown in FIG. 4), the controlling section 40 causes the switching valve 39 to be opened, causes the supplying valve 33 to be closed, and causes the fluid flowing mechanism 38 to perform a normal rotational running. If this occurs, the liquid in the internal portion of the circulating path 67 flows in the discharging direction A that goes to the liquid ejecting section 12. According to this, the fluid including gas bubbles in the internal proportion of the pressure chamber 42 are discharged to the discharging path 25 through the communicating port 35.

Further, in this case, the communicating port 35, the discharging path 25, connecting port 34, the supplying chamber side supplying path 66, the fluid storage section 49, the circulating path 67, the common liquid chamber 64, the ejecting section side supplying path 29, the outlet 31, and the pressure chamber 42 communicate with each other, and thus the fluid flows to be circulated. In other words, in the pressure chamber 42, even if the liquid is spilled from the communicating port 35, the liquid flows into the pressure chamber 42 from the outlet 31. Therefore, the valve body 43 is located in the valve closing position to regulate the communication between the supplying chamber 27 and the pressure chamber 42.

Hereinafter, a description will be made of an operation in a case where the liquid circulates in the supplying mechanism 63.

Herein, in a state where the liquid ejecting section 12 is capped by the cap 18 (not shown in FIG. 4), the controlling section 40 causes the supplying valve 33 to be closed, causes the switching valve 39 to be opened, and causes the fluid flowing mechanism 38 to perform a reverse rotational running. If this occurs, the liquid in the internal portion of the circulating path 67 flows in the circulating direction C that goes from the fluid flowing mechanism 38 to the fluid storage section 49.

If this occurs, the liquid flows into the pressure chamber 42 from the communicating port 35 and the valve body 43 is located in the valve closing position to regulate the communication between the supplying chamber 27 and the pressure chamber 42. For this reason, the liquid stored in the pressure chamber 42 is drawn out of the outlet 31.

Accordingly, the liquid circulate to pass through the pressure chamber 42, the outlet 31, the ejecting section side supplying path 29, the common liquid chamber 64, the circulating path 67, the fluid storage section 49, the supplying chamber side supplying path 66, the connecting port 34, the discharging path 25 and the communicating port 35 in the order listed.

Hereinafter, a description will be made of an operation of the supplying mechanism 63 in a case where a pressurizing cleaning is performed on the liquid ejecting section 12.

Herein, in a state where the liquid ejecting section 12 is capped by the cap 18 (not shown in FIG. 4), the controlling section 40 causes the switching valve 39 to be closed, causes the supplying valve 33 to be opened, and causes the fluid flowing mechanism 38 to perform a normal rotational running. If this occurs, the liquid flows in the discharging direction A that goes from the fluid flowing mechanism 38 to the liquid ejecting section 12.

In other words, the liquid accommodated in the liquid accommodating section 14 is supplied to the liquid ejecting section 12 through the supplying valve side supplying path 65, the fluid storage section 49 and a circulating path 67, and is discharged from the nozzle 17.

According to the fourth embodiment, in addition to the effect (1) to (14) of the first embodiment to the third embodiment, it is possible to obtain the following effect.

(15) It is possible not only to discharge the gas bubbles in the internal portion of the pressure chamber 42, but also to circulate the liquid stored in the common liquid chamber 64.

Further, the embodiments described above may be modified as follows.

In each embodiment, when the switching valve 39 is opened, and in a state where the discharging path 25 is pressurized, the liquid flows into the pressure chamber 42 from the communicating port 35. Further, when the gas bubbles are discharged from the pressure chamber 42, or the like, while the fluid flowing mechanism 38 is caused to perform the normal rotational running, the switching valve 39 may be opened. Further, in a case where the fluid flows into the pressure chamber 42, the supplying valve 33 is closed. In this state, after the liquid is discharged from the nozzle 17, the gas bubbles may be discharged from the pressure chamber 42, and the like.

Figure 5:
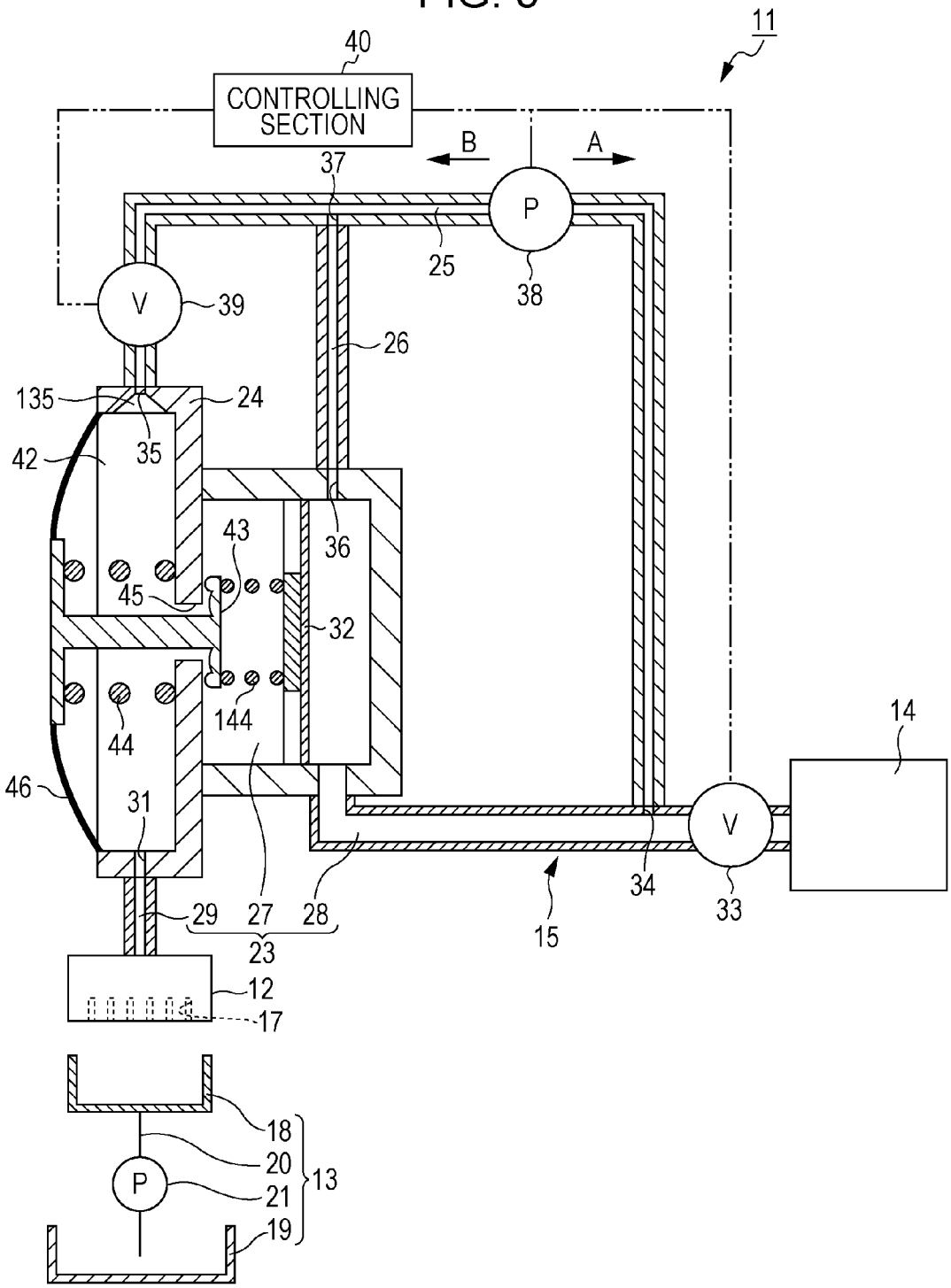
FIG. 5 is a schematic sectional view showing a liquid ejecting apparatus of one embodiment.

In each embodiment, the force exerting member 44 of the pressure adjusting valve 24 may be provided in the internal portion of the supplying chamber 27. In other words, the force exerting member 44 may be provided to push the valve body 43 in the direction that goes from the supplying chamber 27 to the pressure chamber 42. Further, as shown in FIG. 5, the force exerting member 44 of the pressure adjusting valve 24 may be provided in the internal portion of the pressure chamber 42, and the force exerting member 144 may be provided in the internal portion of the supplying chamber 27 to push the valve body 43 in the direction that goes from the supplying chamber 27 to the pressure chamber 42.

In each embodiment described above, the pressure chamber 42 may be configured to include a diaphragm 46 that constitutes a part of the pressure chamber 42. In this case, it is not necessary for the valve body 43 to be inserted into the opening hole 45, and the opening hole 45 may be provided to be blocked from the pressure chamber 42 side. In other words, there may be provided a configuration in which a differential pressure between the pressure chamber 42 and the supplying chamber 27 may cause the valve to be opened.

In each embodiment described above, the pressure adjusting valve 24 may be forcedly opened by a cam and the like. Further, an air chamber may be provided in the external surface of the diaphragm 46, or an air chamber may be provided to cover the entire portion of the pressure adjusting valve 24. Furthermore, the pressure in the internal potion of such an air chamber may be changed to thereby open the pressure adjusting valve 24.

In each embodiment described above, when the gas bubbles are discharged from the pressure chamber 42, the supplying valve 33 may be opened.

In the first embodiment, there may be provided a configuration in which the bypass path 26 is not provided. Further, the supplying port 36 connecting to the bypass path 26 may be provided in the accommodating section side supplying path 28. In other words, the bypass path 26 may be provided to connect the accommodating section side supplying path 28 and the discharging path 25 with each other.

In the first embodiment described above, the bypass path 26 may be provided with the connecting port 34.

In the first embodiment described above, the accommodating section side supplying path 28 may be provided with the fluid flowing mechanism 38. Further, the bypass path 26 may be provided with the fluid flowing mechanism 38.

In the first embodiment described above, during circulation of fluid, in a state where the switching valve 39 is opened, the fluid flowing mechanism 38 may be driven.

In the first embodiment, during circulation of fluid, the fluid flowing mechanism 38 may be caused to perform the reverse rotational running so as to perform the circulation in the cleaning direction B. Further, in this case, at least one of the switching valve 39 and the supplying valve 33 may be opened.

In the first embodiment, when the gas bubbles are discharged from the pressure chamber 42, the controlling section 40 may cause the driving of the fluid flowing mechanism 38 to be stopped before the liquid discharged from the pressure chamber 42 again returns to the pressure chamber 42.

In the second embodiment, the accommodating section side supplying path 28 may be provided with the fluid flowing mechanism 38.

In the second embodiment, there may be a bypass path that connects the supplying chamber 27 and the fluid storage section 49 with each other. Further, there may be a bypass path that connects the supplying chamber 27 and the discharging path 25 with each other. In a case where the bypass path is provided, in a state where the supplying valve 33, the switching valve 39 and the atmospheric opening valve 52 are closed, it is possible to cause the fluid flowing mechanism 38 to perform the normal rotational running or the reverse rotational running and to thereby be capable of circulating the liquid without the intervention of the pressure adjusting valve 24. Further, in a case where there is provided a bypass path, the bypass path may be provided with the connecting port 34 or the fluid flowing mechanism 38.

In the second embodiment, in a state where the switching valve 39 is closed, the fluid flowing mechanism 38 is caused to perform the reverse rotational running and thus the fluid storage section 49 is pressurized, and the atmospheric opening valve 52 may be opened. Further, if the liquid surface in the internal portion of the fluid storage section 49 is raised, the atmospheric opening valve 52 may be closed.

In the second embodiment, in a case where the atmospheric opening valve 52 is opened to discharge the gas, the controlling section 40 may cause the switching valve 39 to be closed.

In the second embodiment, one among the discharging path 25, the accommodating section side supplying path 28 and the supplying chamber 27 may be provided with the atmospheric opening valve 52.

In the third embodiment, the controlling section 40 may perform opening/closing control on the switching valve 39.

In the third embodiment, the normally closed valve 61 may be a connector that is connected to the switching valve 39 to thereby open the switching valve 39.

In the third embodiment, there may be provided a bypass path that connects the supplying chamber 27 and the fluid storage section 49 with each other, or a circulating path that connects the fluid storage section 49 and the accommodating section side supplying path 28.

In the fourth embodiment, in a case where the liquid is circulated, the switching valve 39 may be closed and the fluid flowing mechanism 38 may be caused to perform the reverse rotational running.

In the second embodiment to the fourth embodiments, the fluid storage section 49 may be provided with a penetrating film through which the gas penetrates, and a deaeration may be performed with respect to the fluid storage section 49.

In the second embodiment to the fourth embodiments, the fluid storage section 49 is provided in a higher position than the position of the liquid ejecting section 12 in the vertical direction, and the difference between water surface levels is used to perform the pressurizing cleaning on the liquid ejecting section 12. In other words, the switching valve 39 is opened, and the atmospheric opening valve 52 is opened, and the liquid stored in the fluid storage section 49 may be supplied to the liquid ejecting section 12 through the pressure adjusting valve 24.

In the second embodiment to the fourth embodiment, the fluid storage section 49 may be provided with a fluid flowing mechanism that is capable of performing pressurizing and decompressing. In other words, the internal portion of the fluid storage section 49 may be decompressed to discharge the gas. Further, the internal portion of the fluid storage section 49 may be pressurized to perform the pressurizing cleaning on the liquid ejecting section 12.

In each embodiment described above, there may be provided a configuration in which the fluid flowing mechanism 38 is not provided. Since the gas bubble staying in the pressure chamber 42 has a lighter weight of that of the liquid, the gas bubbles tends to be upwardly moved. Accordingly, the switching valve 39 can be opened to cause the gas bubbles to be released into the discharging path 25 even in a case where the fluid flowing mechanism 38 is not provided.

In each embodiment described above, the fluid flowing mechanism 38 perform the normal rotational running and the reverse rotational running to be capable of performing the two-way flowing. However, it may be possible for the fluid flowing mechanism 38 to perform one-way flowing.

In each embodiment described above, in a case where the fluid flowing mechanism 38 is caused to be driven, the controlling section 40 may cause the fluid flowing mechanism 38 to be driven so that the negative pressure in the internal portion of the pressure chamber 42 can be equal to or less than a pressure that causes the pressure adjusting valve 24 to be opened. In other words, the pressure adjusting valve 24 may not be caused to be opened.

In each embodiment described above, in a case where the fluid flowing mechanism 38 is caused to be driven, the controlling section 40 may the fluid flowing mechanism 38 to be driven so that the negative pressure in the internal portion of the pressure chamber 42 can be equal to or greater than the pressure resistance of the meniscus.

In each embodiment described above, there may not be provided a cap 18. There may be provided a cap that only surrounds the space including the nozzle 17 without sealing of the space. Further, as shown in FIG. 1, the cap 18 is not limited to a box having an opening and a bottom. For example, an annular elastic member surrounding an area on which the nozzle 17 is opened is disposed in the liquid ejecting section 12, and there may be provided the cap 18 as a member that is made to contact the elastic member to seal the space. Further, when the gas bubbles are discharged from the pressure chamber 42, there may be provided only a configuration in which the cap 18 is located at a position facing the nozzle 17 without the capping performed by the cap 18.

In each embodiment described above, the waste liquid path 20 may be provided with the connecting port 34 and the discharging path 25 may be connected to the waste liquid path 20.

In each embodiment described above, the supplying chamber 27 may be provided with the connecting port 34.

In each embodiment described above, the communicating port 35 and the outlet 31 may be provided to be identical to each other in the position thereof in the vertical direction. Further, the outlet 31 may be located in the upper position, relative to the position of the communicating port 35.

In each embodiment described above, in order to easily collect the gas bubbles in the pressure chamber 42 into the communicating port 35, the opening of the communicating port 35 may be greater than that of the discharging path 25, and the discharging path 25 may become gradually thinned from the pressure chamber 42. For example, as shown in FIG. 5, the gas bubble collecting section 135 for easily collecting the gas bubbles in the pressure chamber 42 into the communicating port 35 may have a tapered shape which is formed such that the opening of the communicating port 35 opened to the pressure chamber 42 is larger than the diameter of the discharging path 25 (the discharging path 57 in the third embodiment), and thus the discharging path 25 may become gradually thinned into a tapered shape from the pressure chamber 42.

In each embodiment described above, in order to easily collect the gas bubbles in the pressure chamber 42 into the communicating port 35, the internal surface that forms the pressure chamber 42 and faces the diaphragm 46 may be inclined in the direction of coming gradually close to the diaphragm 46 (inclined to the left side in FIG. 1) in the upward direction of the vertical direction, the internal surface is inclined in the direction of coming gradually close to the diaphragm 46 in the upward direction of the vertical direction, and thus, the upper end of the internal surface may be connected to the opening of the communicating port 35.

Figure 6:
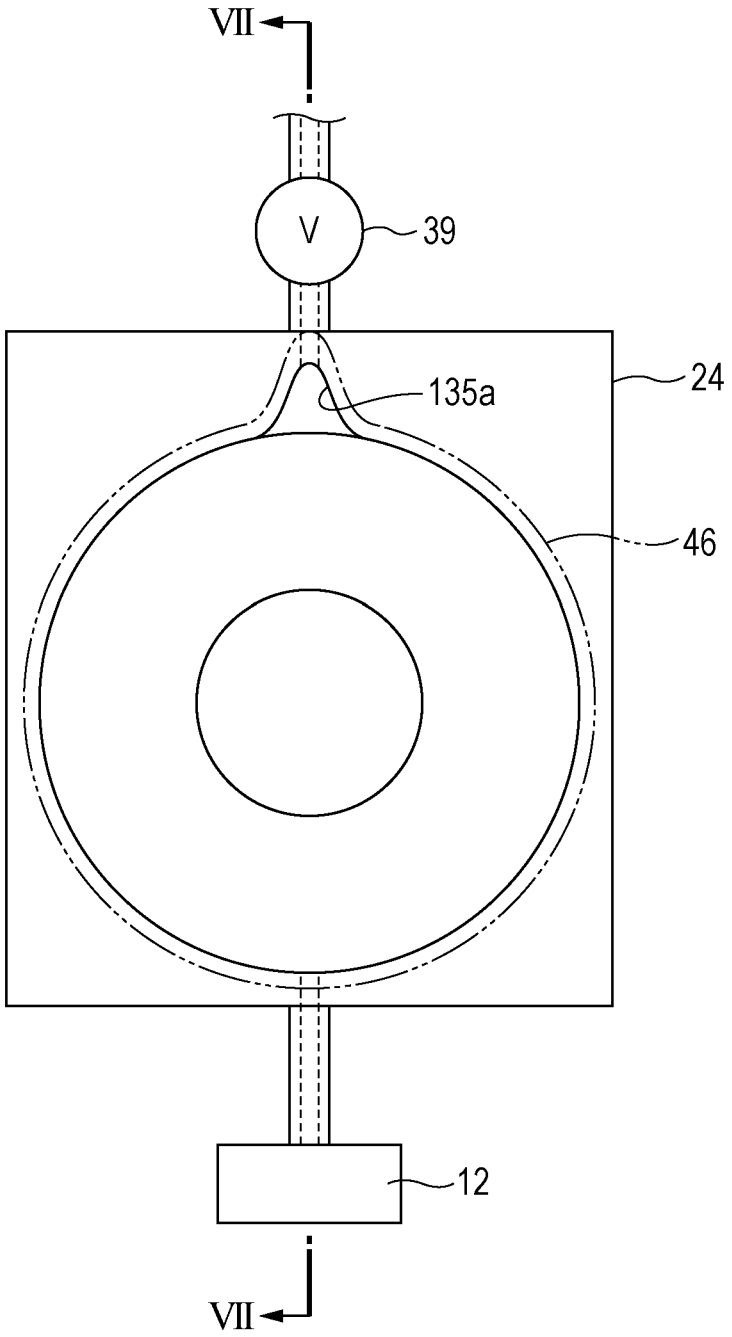
FIG. 6 is a side view showing a pressure adjusting valve of one embodiment.
Figure 7:
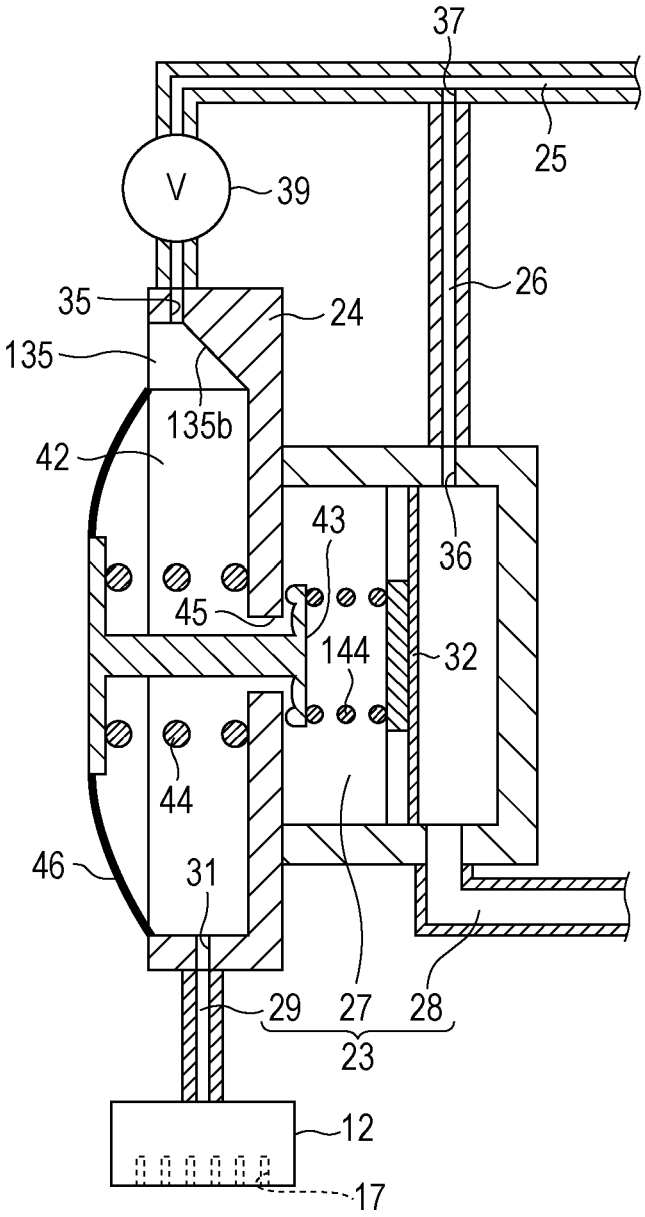
FIG. 7 is a sectional view taken along arrow line VII-VII in FIG. 6.

In each embodiment described above, as shown in FIG. 6 and FIG. 7, the gas bubble collecting section 135 for easily collecting the gas bubbles in the pressure chamber 42 into the opening of the communicating port 35 may be configured to include an aculeate shape section 135*a* and the diaphragm 46. An upper portion of the internal surface forming the pressure chamber 42 in the vertical direction is an aculeate shape section 135*a* and the acute peak of the aculeate shape section goes toward the communicating port 35. Further, the internal surface that forms the pressure chamber 42 and faces the diaphragm 46 may be inclined in the direction of coming gradually close to the diaphragm 46 in the upward direction of the vertical direction, and to thereby form the inclined surface 135*b*, and thus, the upper end of the inclined surface 135*b* may be connected to the opening of the communicating port 35.

In each embodiment described above, in order to easily collect the gas bubbles in the pressure chamber 42 into the communicating port 35 and cause the gas bubbles in the pressure chamber 42 to hardly flow into the liquid ejecting section 12, the communicating port 35 may be configured to be larger than the outlet 31. Further, the opening of the communicating port 35 opened to the pressure chamber 42 may be configured to be larger than the opening of the outlet 31 opened to the pressure chamber 42.

In the first embodiment to the third embodiment, as shown in FIG. 5, when the fluid flowing mechanism 38 is driven to cause the liquid in the internal portion of the discharging path 25 (the discharging path 57 in the third embodiment) to flow, in order that the liquid is caused to easily flow and it is difficult for a change in the pressure caused by the flow of the liquid to influence the meniscus in the nozzle 17, and a sectional area of the flow path in the discharging path 25 (the discharging path 57 in the third embodiment) may be greater than a sectional area of the flow path in the ejecting section side supplying path 29 so that the discharging path can have a low flow path resistance.

In the first embodiment to the third embodiment, as shown in FIG. 5, the sectional area of the flow path in the discharging path 25 (the discharging path 57 in the third embodiment) may be greater than a sectional area of the flow path in the bypass path 26 so that the discharging path can have a low flow path resistance.

In the first embodiment to the second embodiment, as shown in FIG. 5, the sectional area of the flow path in accommodating section side supplying path 28 may be greater than a sectional area of the flow path in the discharging path 25 so that the accommodating section side supplying path can have a low flow path resistance.

In the embodiment described above, the liquid ejecting apparatus may eject or discharge liquids other than the ink. Further, types of liquid discharged from the liquid ejecting apparatus in the form of small amounts of droplets may also include granular shape, a tear shape, and a shape having a tail like a thread. Further, the liquid referred to herein may be any material as long as the material can be ejected from the liquid ejecting apparatus. For example, the materials may includes a fluid-like body such as a material having a state of a liquid phase, a liquid phase body having a high or low viscosity, sol or gel water, other inorganic solvents, organic solvents, solutions, a liquid phase resin, and a liquid phase metal (a molten metallic liquid). Further, such a materials may include not only a liquid as a state of the material, but also something in which particles of a functional material formed of solid material such as pigment or metallic particles are resolved, dispersed or mixed in a solvent, and the like. A typical example of the liquid may include the ink, the liquid crystal and the like as described in the above embodiment. Herein, the inks may include aqueous ink, oily ink, something containing various liquid phase compositions such as gel ink, hot melt ink, and the like. A specific example of the liquid ejecting apparatus may include a liquid ejecting apparatus that ejects a liquid containing material such as an electrode material or coloring material of the dissolved or dispersed form that is used for manufacturing, for example, a liquid crystal display, an electroluminescence (EL) display, a surface light emitting display, a color filter and the like. Further, the specific examples may include a liquid ejecting apparatus that ejects a living body organic matter used for manufacturing a biochip, a liquid ejecting apparatus that ejects a liquid corresponding to a test material used as a precision pipette, a printing machine, a micro-dispenser and the like. Further, the specific examples may include a liquid ejecting apparatus that ejects a lubricant using a pinpoint in a precision machine such as a watch or a camera, and a liquid ejecting apparatus that ejects, on a substrate, a transparent resin liquid such as an ultraviolet curing resin for forming a micro-hemisphere lens (optical lens) and the like used for an optical communication element. Further, the specific example may include a liquid ejecting apparatus that ejects an etching liquid having an acid, an alkali or the like for etching a substrate and the like.

The entire disclosure of Japanese Patent Application No. 2014-139411, filed Jul. 7, 2014 and No. 2015-019075, filed Feb. 3, 2015 are expressly incorporated by reference herein.

What is claimed is:

1. A liquid ejecting apparatus comprising:

a liquid ejecting section that includes a nozzle that ejects a liquid;

a supplying path that is capable of supplying the liquid accommodated in a liquid accommodating section to the liquid ejecting section, wherein the supplying path has a first end coupled to the liquid accommodating section;

a pressure adjusting valve that is disposed in the supplying path, and includes a pressure chamber which is capable of storing the liquid, wherein the pressure chamber is provided with an outlet that draws out the stored liquid to the liquid ejecting section, and wherein when the liquid is drawn out of the outlet to the liquid ejecting section to thereby cause a pressure in the internal portion of the pressure chamber to decrease, the pressure adjusting valve is opened to cause the supplying path and the pressure chamber to communicate with each other and thereby adjusts a pressure of the liquid supplied to the liquid ejecting section;

a discharging path that connects to a communicating port which communicates with the pressure chamber in a separate position different from a position of the outlet; and a switching valve that is provided in the discharging path.

2. The liquid ejecting apparatus according to claim 1, wherein the communicating port is opened in a higher position than the outlet in the pressure chamber.

3. The liquid ejecting apparatus according to claim 1, further comprising:

a fluid storage section in a higher position than the communicating port of the discharging path.

4. The liquid ejecting apparatus according to claim 1, wherein the discharging path is connected to the supplying path through a connecting port, and the connecting port is located farther opposite to the liquid ejecting section than the pressure adjusting valve in the supplying path.

5. The liquid ejecting apparatus according to claim 4, further comprising:

a bypass path that connects the switching valve and the connecting port in the discharging path, and the pressure adjusting valve and the connecting port in the supplying path.

6. The liquid ejecting apparatus according to claim 1, further comprising:

a cap that is capable of sealing a space including the nozzle, wherein in a state where the space is sealed by the cap, the switching valve is caused to be opened to thereby discharge the fluid in the internal portion of the pressure chamber through the discharging path.

7. The liquid ejecting apparatus according to claim 1, further comprising:

a fluid flowing mechanism that is provided to be capable of discharging the fluid in the internal portion of the pressure chamber through the discharging path, wherein when discharging the fluid in the internal portion of the pressure chamber through the discharging path, the fluid flowing mechanism is driven such that a negative pressure acting on the nozzle is smaller than a pressure resistance of a meniscus formed in the nozzle.

8. The liquid ejecting apparatus according to claim 1, further comprising:

a fluid flowing mechanism that is provided to be capable of discharging the fluid in the internal portion of the pressure chamber through the discharging path, wherein when discharging the fluid in the internal portion of the pressure chamber through the discharging path, the fluid flowing mechanism is driven such that a negative pressure acting on the pressure chamber is greater than a pressure that causes the pressure adjusting valve to be opened.

9. The liquid ejecting apparatus according to claim 1, further comprising:

a fluid flowing mechanism that is provided to be capable of discharging the fluid in the internal portion of the pressure chamber through the discharging path, or introducing the fluid to the internal portion of the pressure chamber, wherein in a state where the switching valve is opened, the fluid flowing mechanism is driven such that the fluid is introduced from the communicating port to the internal portion of the pressure chamber.

10. The liquid ejecting apparatus according to claim 1, further comprising:

a fluid flowing mechanism that is provided farther from the communicating port than the switching valve in the discharging path and is capable of causing the fluid to flow; and a fluid storage section that is provided between the switching valve and the fluid flowing mechanism and includes an atmospheric opening valve which is capable of causing the internal portion of the fluid storage section to be opened to the atmosphere, wherein in a state where the switching valve is opened, the fluid flowing mechanism is driven such that the fluid in the internal portion of the pressure chamber is caused to flow into the internal portion of the discharging path, and wherein in a state where the switching valve is closed and in a state where the atmospheric opening valve is opened, the fluid flowing mechanism is driven such that the fluid in the internal portion of the discharging path flows in the direction that proceeds to the pressure chamber.

11. The liquid ejecting apparatus according to claim 1, further comprising:

a gas bubble collecting section that is formed in a lower position than a position of the communicating port in the internal portion of the pressure chamber.

12. The liquid ejecting apparatus according to claim 11, further comprising:

a diaphragm that constitutes a part of the pressure chamber and is capable of being flexibly deformed, wherein the gas bubble collecting section is configured to include an aculeate shape section and the diaphragm, an upper portion of an internal surface of the pressure chamber in the vertical direction is the aculeate shape section and the acute peak of the aculeate shape section faces toward the communicating port.

13. The liquid ejecting apparatus according to claim 1, wherein an opening of the outlet opened to the pressure chamber is smaller than an opening of the communicating port opened to the pressure chamber.

* * * * *